United States Patent [19]

Ebersole et al.

[11] Patent Number: 5,034,758

[45] Date of Patent: Jul. 23, 1991

[54] DUST SHIELD FOR A PRINTER

[75] Inventors: Anthony W. Ebersole, Poway; Robert W. Beauchamp, Leucadia; Chuong C. Ta, San Diego, all of Calif.

[73] Assignee: Hewlett-Packard Company, Palo Alto, Calif.

[21] Appl. No.: 423,623

[22] Filed: Oct. 17, 1989

Related U.S. Application Data

[63] Continuation of Ser. No. 191,838, May 9, 1988, abandoned, which is a continuation of Ser. No. 24,645, Mar. 11, 1987, abandoned.

[51] Int. Cl.[5] ..... B41J 11/26

[52] U.S. Cl. ..... 346/146; 400/616

[58] Field of Search ..... 346/25, 136, 139 R, 346/146; 400/717, 699, 616, 616.1, 616.2, 616.3

[56] References Cited

U.S. PATENT DOCUMENTS

| | | | |
|---|---|---|---|
| 4,326,656 | 4/1982 | Gregory et al. | 400/616.3 X |
| 4,376,589 | 3/1983 | Avellanet et al. | 400/616.3 X |
| 4,411,706 | 10/1983 | Wallace | 346/25 X |
| 4,569,468 | 2/1986 | Neer | 400/616.1 |

*Primary Examiner*—Mark J. Reinhart

[57] ABSTRACT

A dust shield for preventing paper dust from fouling a printer and printhead mechanism is disclosed. In a sprocket-wheel paper drive printer, the sprockets are at least partially encased as they enter and exit the holes in the paper. Paper particles are trapped and then channelled away from mechanisms, such as a thermal ink jet cartridge printhead, whose operation may be detrimentally affected by such dust.

5 Claims, 4 Drawing Sheets

DUST SHIELD FOR A PRINTER

This is a continuation of co-pending application Ser. No. 07/191,838 filed on May 9, 1988, which in turn is a continuation of application Ser. No. 07/024,645 now abandoned.

BACKGROUND OF THE INVENTION

1. Field of the Invention

The present invention generally relates to printers such as those which are commonly used in conjunction with a computer terminal. More particularly, the present invention relates to a shielding device for keeping printing media particles away from the printhead and other moving parts of the printer that such particles or accumulations of particles can disrupt.

2. Description of the Related Art

One of the problems with the use of computer-type printers is paper dust and accumulations of paper dust or the interference such can cause to the printhead and other moving parts within the printer. For example, in an impact-hammer type printhead, dust can accumulate on the hammerheads and degrade the print quality. The problem is increased when the printer uses continuous, fan-fold paper which has perforations between each sheet. If the paper is of the type which uses sprocket wheel paper advance drive, sprocket holes and perforations also exist along tear-off strips on each side of each sheet, adding further sources of unwanted paper dust.

In fact, experiments by the inventors indicate that the primary source of paper dust is the sprocket holes themselves. In other words, as the sprocket is inserted and withdrawn during paper advance, the contact between the sprocket and the perimeter of each sprocket hole creates paper dust.

Paper dust is particularly a nuisance to a thermal ink jet printhead which has a set of tiny orifices designed to eject boiled ink vapor droplets. A single particle of paper dust may be sufficient to clog such an orifice. A general description of such ink jet technology can be found, for example, in the *Hewlett Packard Journal*, Volume 36, Number 5, May 1985.

WALLACE ET AL., U.S. Pat. No. 4,411,706, present a method and apparatus for keeping dust away from ink jet printhead orifices by using an air counterflow technique. This concept requires complicated, costly mechanism design.

Hence, there is a need for a simple means for preventing paper dust from interfering with the operational parts of a printer.

SUMMARY OF THE INVENTION

In a basic aspect, the present invention is a shielding device for a printer having a sprocket wheel drive assembly, comprising means for catching dust particles given off by the the printing media, e.g. fan-fold paper, at said assembly; and means for channelling said dust from away from said catching means.

An advantage of the present invention is that it decreases the susceptibility of the printhead to paper dust interference or clogging.

Another advantage of the preferred embodiment of the present invention is that it provides protection for the printhead by holding down the sides of the print media as it passes by the printhead.

Other objects, features and advantages of the present invention will become apparent upon consideration of the following detailed description and the accompanying drawings, in which like reference designations represent like features throughout the FIGURES.

BRIEF DESCRIPTION OF THE DRAWINGS

FIGS. 3–3B are schematic plan views of the present invention as shown in FIG. 1 in which FIGS. 3 and 3A are side views and 3B is taken in plane 4—4 as shown in FIG. 3.

The drawings referred to in this description should be understood as not being drawn to scale except if specifically noted.

DETAILED DESCRIPTION OF THE INVENTION

Figure 1:
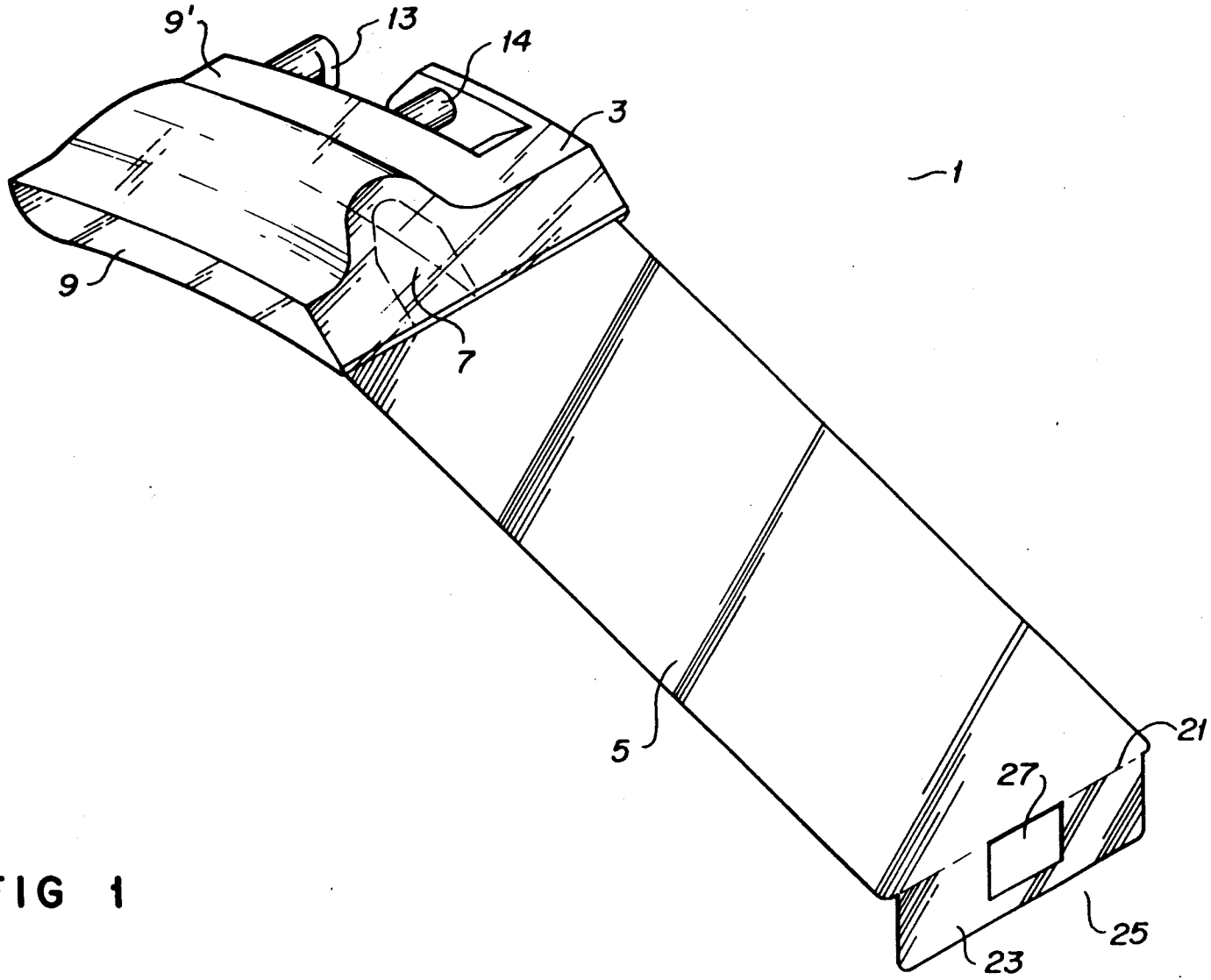
FIG. 1 is a schematic perspective view of the preferred embodiment of the present invention.

Reference is made now in detail to a specific embodiment of the present invention, which illustrates the best mode presently contemplated by the inventor(s) for practicing the invention. Alternative embodiments are also briefly described as applicable. Referring now to FIG. 1, a preferred embodiment of the dust shield 1 of the present invention is shown. Each sprocket wheel paper drive assembly of the printer is to be equipped with such a shield 1. The dust shield 1 has two particular features: a sprocket hole dust catcher 3 and a channeling plate 5.

Figure 2:
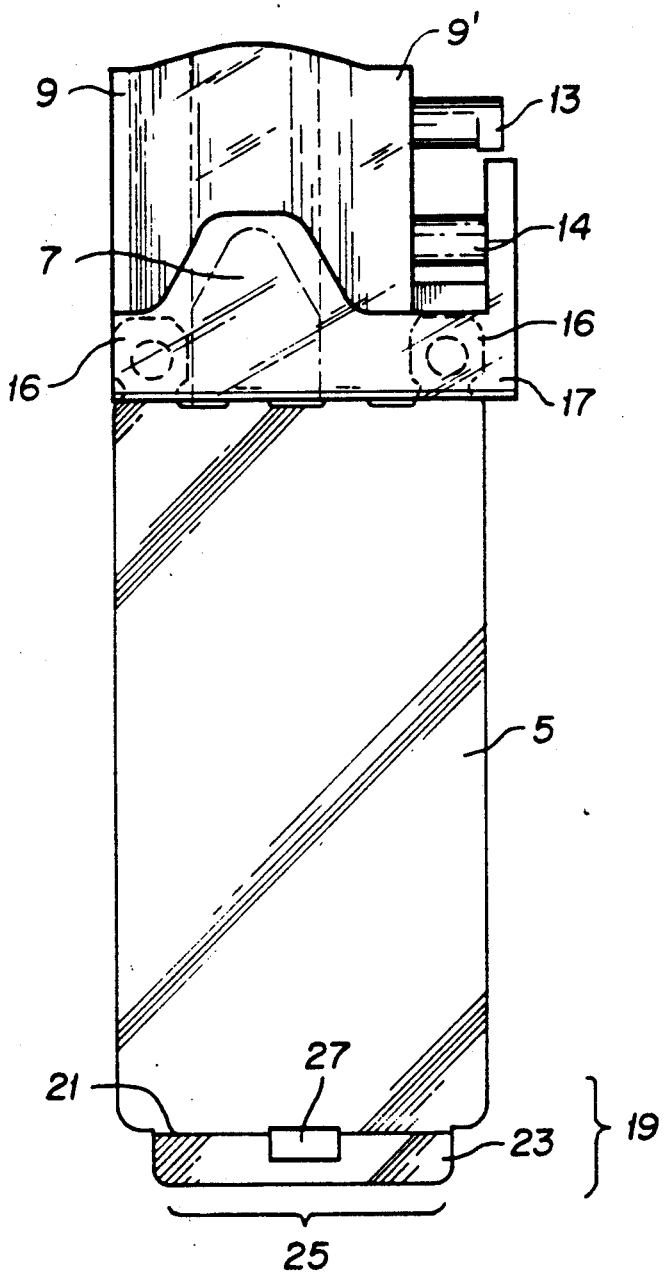
FIG. 2 is a schematic plan view (front) of the present invention as shown in FIG. 1.
Figure 3A:
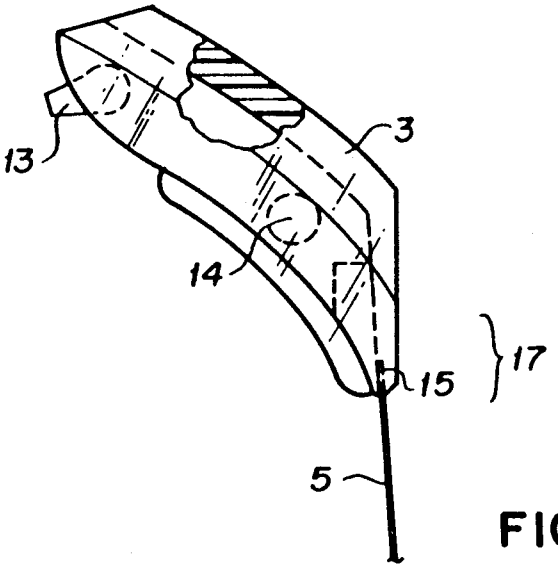
Figure 3B:
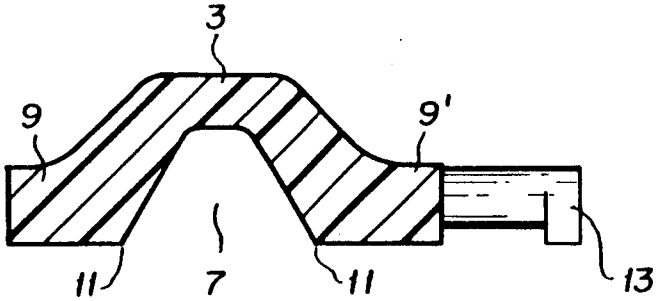
Figure 3:
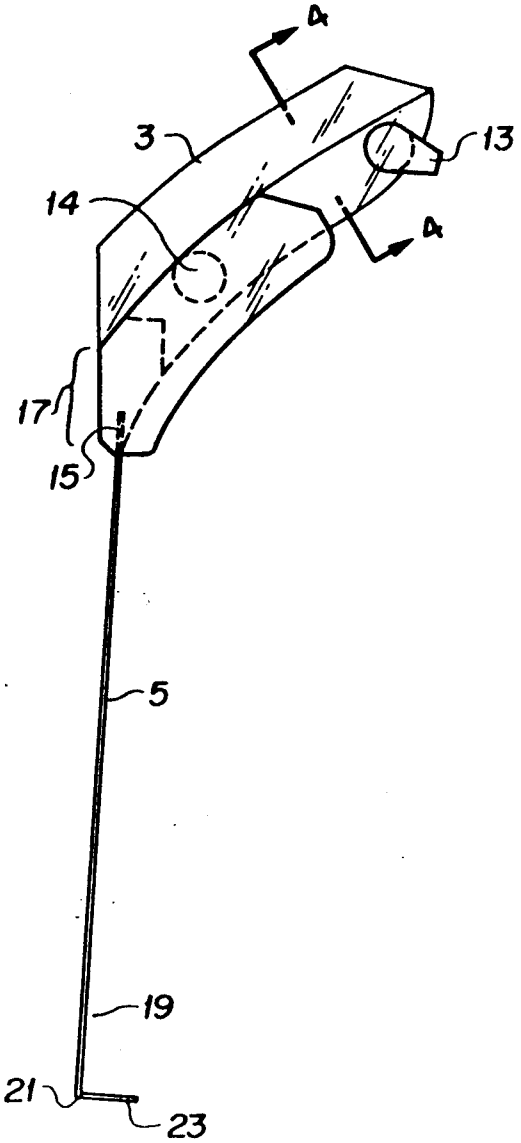
Figure 4:
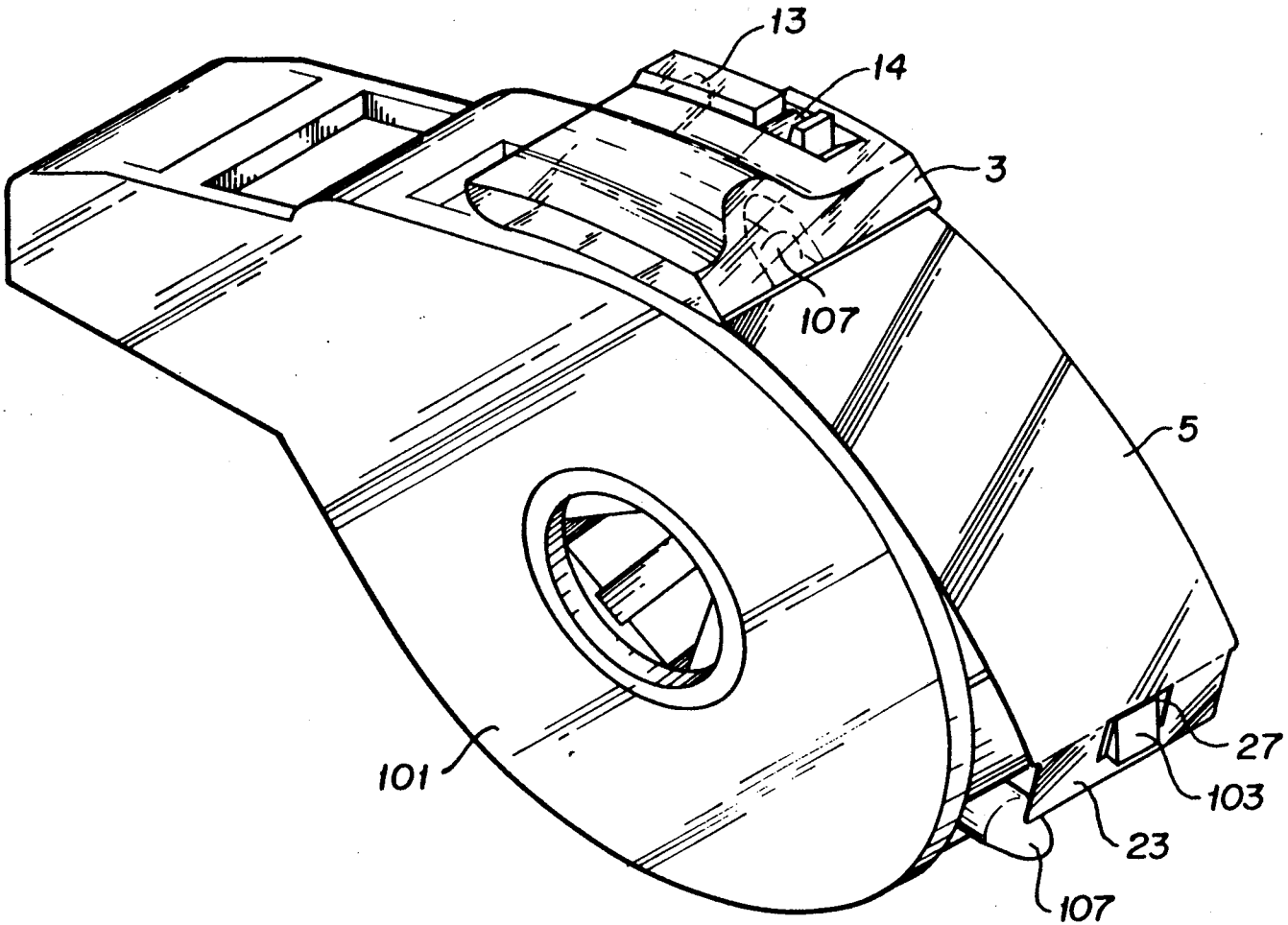
FIG. 4 is a perspective view of the embodiment as shown in FIG. 1 in combination with a sprocket wheel assembly.

The catcher 3, as shown in more detail in FIGS. 2 and 3, is formed to have a curved channel region 7 which will allow free passage of paper catching sprockets. A shield strip 9, 9' borders each side of the channel region 7 in order to prevent paper dust particles generated by the sprocket/paper hole contact from being discharged over the rim 11 of the channel region 7 where it still could cause a problem, such as by transferring to and blocking a printhead orifice (not shown). There is also provided a keyed pin 13 for connecting the catcher 3 to a sprocket wheel assembly 101 as shown in FIG. 4. The combination of keyed pin 13 with fixed pin 14 aligns and connects the shield 1 to the sproket wheel assembly 101.

As will be apparent to a person skilled in the art, the channel region can be made large enough also to guide larger pieces of paper which may be torn loose by the sprocket assembly out of the top of the catcher where they can be easily removed by the operator.

The channeling plate 5 in this embodiment is formed of a thin, flexible metal sheet. Its upper edge 15 is connected to the lower edge 17 of the catcher 3, such as by well-known insert molding techniques, e.g. tabs 16 are inserted into the mold prior to plastic injection. The lower portion 19 of the plate 5 has a bend 21. The flat 23 which forms the lower end 25 of the channeling plate 5 has a catch-hole 27 for attaching the channeling plate 5 to the sprocket wheel assembly 101, as shownin FIG. 4, by allowing a catch projection 103 on the assembly 101 to be inserted into the catch-hole 27.

As will be recognized by a person skilled in the art, the channeling plate 5 and the shield strips 9, 9' can also act as a paper guide to prevent the sprockets 107 from prematurely releasing the paper. By having the dust shield 1 fixed to the drive sprocket assembly 101, the need for the operator to open and close typical, known sprocket paper hold-down mechanisms is eliminated.

In operation, as can be seen in FIG. 4, the sprocket wheel 105 rotates (counter-clockwise) and the sprockets 107 grab and pull the paper around the wheel assembly 101. As the wheel 105 turns, the sprockets 107 are partially encased firstly by the channelling plate 5 and, secondly, by the catcher 3, the prockets passing unimpaired along the channel 7. Paper dust emitted from each hole in the paper tear-off strips falls (generally due to the force of gravity) down the catcher channel region 7 to the channel plate 5. The shield strips 9, 9' prevent dust particles from being emitted over the rim of the channel region 7. The channel plate 5 further directs the paper dust particles away from the operational mechanisms of the printer toward the bottom of the sprocket wheel assembly 101 where it can be safely released to fall to the bottom of the printer housing (not shown). If the sprockets 107 enter the paper holes before reaching the position where the sprocket is in the channel region 7 of the catcher 3, dust emitted will fall directly onto the channeling plate 5 and thus be channelled toward the bottom of the printer housing.

It will also be recognized by a person skilled in the art that the paper dust shield could be constructed from many materials Moreover, the invention could be made as an integral unit and even as an integral member of a sprocket wheel assembly. Furthermore, the dust shield 1 can be made to be retrofitted to sprocket wheel assemblies by modifying the pin 13 and catch-hole 27 to adapt the dust shield to the particular sprocket wheel assembly in question.

The foregoing description of the preferred embodiment of the present invention has been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application to thereby enable others skilled in the art to understand the invention for various embodiments and with various modifications as are suited to the particular use contemplated. It is intended that the scope of the invention be defined by the claims appended hereto and their equivalents.

What is claimed is:

1. A printing media particle shielding device mounted on a printer sprocket wheel drive assembly for advancing printing media, said printer having a means for printing on said media, comprising:

means for initially catching particles emitted by said media at said assembly, having an enclosed channel region for catching and directing said particles away from said means for printing; and means for channelling said particles, attached to said means for initially catching particles, for channeling said particles away from aid means for initially catching particles, said assembly, and said means for printing.

2. The device as set forth in claim 1, wherein said means for initially catching particles further comprises: shield strip members along each upper rim of said channel region for inhibiting the emission of said particles over said rim.

3. A paper dust shield for a printer having a sprocket wheel paper drive assembly for advancing paper, having edges perforated with peripherally located holes for catching by sprockets of said assembly, passed a printhead, comprising:

a component which fully covers the sprockets of said assembly over that portion of said sprocket wheel wherein said sprockets catch said holes and which downwardly channels paper dust particles emitted by the contact of said sprockets with said paper away from said assembly and said printhead.

4. The paper dust shield as set forth in claim 3, wherein said shield is an integral component of said sprocket wheel paper drive assembly.

5. The paper dust shield as set forth in claim 3, further comprising means for attaching said component to said assembly.

* * * * *